US005225733A

United States Patent [19]

Krasko

[11] Patent Number: 5,225,733

[45] Date of Patent: Jul. 6, 1993

[54] SCANDIUM HALIDE AND ALKALI METAL HALIDE DISCHARGE LAMP

[75] Inventor: Zeya K. Krasko, Beverly, Mass.

[73] Assignee: GTE Products Corporation, Danvers, Mass.

[21] Appl. No.: 808,824

[22] Filed: Dec. 17, 1991

[51] Int. Cl.[5] ..... H01J 17/20

[52] U.S. Cl. ..... 313/25; 313/637; 313/564; 313/567; 313/490; 313/638; 313/640; 313/641

[58] Field of Search ..... 313/25, 637, 638, 639, 313/640, 641, 642, 643, 564, 490, 567

[56] References Cited

U.S. PATENT DOCUMENTS 3,983,513 9/1976 DeCaro .
4,053,805 10/1977 Schotz et al. .
4,247,798 1/1981 Howe et al. ..... 313/642
4,305,017 12/1981 De Ridder et al. .
4,559,471 12/1985 Kroontje .
4,709,184 11/1987 Keeffe et al. .
4,963,790 10/1990 White et al. .
5,057,743 10/1991 Krasko et al. .

FOREIGN PATENT DOCUMENTS 0291123 11/1988 European Pat. Off. .

*Primary Examiner*—Donald J. Yusko
*Assistant Examiner*—N. D. Patel
*Attorney, Agent, or Firm*—Robert E. Walter

[57] ABSTRACT

A scandium halide and alkali metal halide discharge lamp has a chemical fill in the arc tube comprising an inert starting gas, mercury, alkali metal iodides, scandium iodide and platinum metal as an additive for reducing the tendency of the lamps to discolor during operation.

9 Claims, 1 Drawing Sheet

SCANDIUM HALIDE AND ALKALI METAL HALIDE DISCHARGE LAMP

TECHNICAL FIELD OF THE INVENTION

This invention relates to metal halide lamps, and more particularly to metal halide high intensity discharge lamps having better lumen maintenance throughout the life of the lamp.

BACKGROUND OF THE INVENTION

Metal halide lamps have an inner quartz arc tube containing a fill of an arc-sustaining material and surrounded by an outer glass envelope. The metal halide lamp's arc tube fill includes a rare gas for starting and a quantity of mercury. However, as compared to a mercury lamp, the metal halide lamp's emission spectrum is primarily due to the presence in the arc tube fill of one or more metal halides, usually iodides. These metal halides are responsible for a much higher luminous efficacy and better color rendering capability of the lamp output than is possible for the mercury vapor lamp.

The luminous efficacy, color rendering index and other lamp output characteristics may be varied, depending upon the particular composition of the metal halides in the arc tube. GTE's Metalarc M100/U lamp, with a $NaIScI_3CsI$ chemistry, has a CRI (color rendering index) of 65, an initial LPW (lumens per Watt) of 85, and a 10,000 hour lifetime. In the lighting industry, these specifications are considered very good for standard lighting applications. Each chemical in the lamp is chosen to contribute specific effects to the lamp's performance. The mercury controls the current-voltage characteristics of the lamp, and the alkali metal iodides adjust the color quality, and contribute to lumen output through strong emissions. Scandium is added to the lamp as an iodide and as a pure metal. The scandium iodide improves color quality by adding a variety of lines to the color spectrum. The elemental scandium chip is used to adjust the metal/iodine ratio in the lamp and to getter oxygen impurities.

By modifying the above chemistry by the replacement of the element Cesium with Lithium to form a chemistry of $NaIScI_3LiI$, the resulting lamp has an improved CRI of 73 and a high LPW of 85 while still maintaining the 10,000 hour life.

U.S. Pat. No. 4,053,805 to Scholz et al relates to a red emitting metal halide arc discharge lamp utilizing a fill of mercury, scandium and lithium iodide. Lithium iodide imparts a red component to the emitted light. Problems encountered with lithium iodide as a lamp fill component, as set forth in the above patent, include lamp starting problems and electrode attack. These problems were reduced by the addition of scandium metal to the fill.

U.S. Pat. No. 4,709,184 To Keeffe et al relates to a metal halide lamp where the fill consists essentially of sodium iodide and scandium iodide in a molar ratio in the range of about 20:1 to 28:1, elemental mercury, scandium, and an inert gas. U.S. Pat. No. 4,963,790 of Robert S. White and James C. Morris describes a floating frame structure for reversing the sodium electrolysis process. U.S. Pat. No. 5,057,743 to Keeffe and Krasko relates to a metal halide lamp having a chemical fill including sodium iodide, lithium iodide, and scandium iodide. Although lamps exhibit long life, high luminous efficacy, and good color temperature, it is desirable to reduce the tendency of these lamps to reduce lumen output during extended operation.

Because of their superior efficiency and operating life, lamps utilizing a chemical fill of $NaIScI_3$ and LiI or CsI with a scandium metal getter are highly desirable. However, it is desirable to improve lumen maintenance of these alkali metal halide lamps to discolor.

SUMMARY OF THE INVENTION

It is an object of the present invention to improve lumen maintenance of HID lamps utilizing the $NaIScI_3$ and LiI or CsI chemistry while maintaining the intial efficiency and long life characteristic of such lamps.

Other objects and advantages of the present invention are apparent from reading the specification and appended claims.

The present invention provides a scandium halide and alkali metal halide discharge lamp of the type having an improved lumen maintenance during operation. Structurally, the lamp includes a glass envelope; a pair of electrical conductors extending into the interior of the glass envelope and an arc tube disposed therein which includes a pair of electrodes electrically connected to the electrical conductors for creating an electric arc during lamp operation. A chemical fill disposed within the arc tube comprises an inert starting gas, mercury, alkali metal iodides and scandium iodide. The alkali metal iodides are preferably sodium iodide, cesium iodide and/or lithium iodide. The fill additionally includes a platinum chip for reducing the propensity of the lamp to decrease lumen output during operation.

Figure 1:
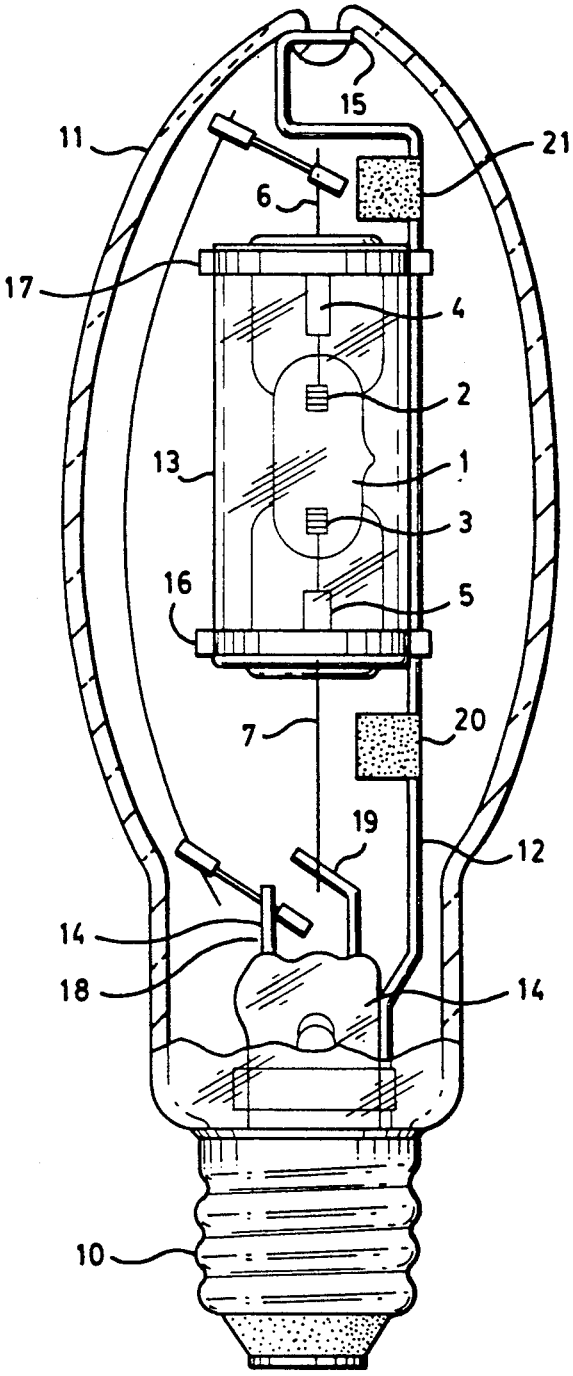
FIG. 1 is a cross-sectional view of a metal halide discharge lamp.

For a better understanding of the present invention, together with other and further advantages and capabilities thereof, reference is made to the following in conjunction with the accompanying drawings.

DETAILED DESCRIPTION

Referring to FIG. 1, there is shown the structural features of a metal halide lamp discharge lamp. The illustrated lamp includes a quartz discharge tube or arc tube 1 disposed within an outer sealed glass envelop 11. The outer envelope is most preferably evacuated. The outer envelope 11 is hermetically sealed to an affixed glass stem member 14 having an external base member 10. A pair of electrical conductors 18 and 19 are sealed into and pass through the stem member 14.

The discharge tube 1 has a pair of electrodes 2 and 3 which project into the interior of the discharge tube 1 at respective ends provide for energization of the discharge lamp by an external source (not shown) during operation. Discharge tube 1 is generally made of quartz although other types of material may be used such a alumina, yttria or silica. Each electrode 2 and 3 comprises a core portion surrounded by molybdenum or tungsten wire helixes.

Each of the electrodes 2 and 3 is connected to respective metal foils 4 and 5, preferably formed of molybdenum which are pinch sealed. Electrical conductors 6 and 7 which are electrically connected to respective foils, 4 and 5, extend outwardly of the respective press seals. Conductors 6 and 7 are respectively connected to the conductors 18 and 19 projecting from the glass stem member 14. As illustrated in the drawing, the connection between conductor 6 and conductor 18 is made by a vertically disposed wire extending exterior to the radiation shield 13. A pair of getters 20 and 21 are mounted to the support structure 12.

The discharge tube 1 which is positioned interior the radiation shield 13 is electrically isolated from the radiation shield 13 and the support structure 12. Such a "floating frame" structure is used to control the loss of alkali metal from the arc tube fill by electrically isolating the support structure. Such a structure is described issued U.S. Pat. No. 5,056,743 to Krasko et al and in U.S. Pat. No. 4,963,790 of White et al which specification is incorporated by reference into the present specification.

Within the outer envelope 11, a support member 12 which is secured to the glass stem member 14 and extends substantially parallel to the longitudinal axis of the lamp includes a envelope attachment 15 at one end. The envelope attachment 15 is in the form of a circular configuration which mates with a dimpled upper partition of the envelope 11 so as to maintain the support structure 12 in proper alignment and resist deformation caused by external shock.

A radiation shield 13 is secured to the support structure 12 by spaced apart straps 16 and 17 which are respectively welded to a vertically aligned portion of the support member 12. The radiation shield 13 has a cylindrical shape and is typically in the form of a quartz sleeve which can have a domed shaped closure at one end. Each of the starps 16 and 17 is made of a spring like material so as to grippingly hold the shield 13 in position. As set forth in U.S. Pat. No. 4,859,899, issued Aug. 22, 1989, the diameter and length of the radiation shield may be chosen with respect to the arc tube dimensions to achieve the optimal radiation redistribution resulting in uniform arc tube wall temperatures.

The drawing illustrates a mogul type base, e.g., such as an E27 screw base but it is contemplated that the lamp may have a double-ended configuration with a recessed single-contact base. The discharge tube for use in a 100 watt size lamp, for example, has an internal diameter of 10 mm and an arc length of 14 mm.

The lamp may include other structural features commonly found in metal halide lamps such as an auxiliary starting probe or electrode, generally made of tantalum or tungsten which may be provided at the base end of the arc tube adjacent the main electrode 3.

The discharge tube 1 contains a chemical fill of inert starting gas, mercury, alkali metal iodides, and scandium iodide. In dispensing the chemical fill into the arc tube of a lamp of the present invention, the non-gaseous components of the fill are preferably dispensed into the unsealed arc tube prior to introduction of the starting gas.

A charge of mercury is present in a sufficient amount so when fully vaporized an arc may be sustained. Such an amount should provide an operating mercury-vapor pressure of from 1 to 10 atmospheres as calculated on the basis of an average gas temperature of about 2000° K. More preferably the mercury dosage in the chemical fill of a lamp may be calculated in accordance with the formula:

$$N(Hg)(mg/cm^3)=7.7D^{1/7}$$

wherein D is the arc tube diameter in millimeters. In addition to mercury, a small charge of an inert ionizable staring gas such as argon is contained within the discharge tube 1. It is contemplated that other noble gases can be substituted for argon provided an appropriate pressure is maintained that is conducive to starting the lamp.

The fill mixture containing scandium halide and alkali metal halides is desirable for achieving a suitable wall temperature conducive to a long life lamp. The preferred ingredients scandium iodide and the alkali metal iodides are preferably present in a ratio which provides a warm color of lamp light output matchup or comparability to the output of an incandescent lamp. As set forth in U.S. Pat. No. 4,709,184 to Keeffe and Krasko, sodium iodide and scandium iodide are preferably present in a molar ratio of from about 20:1 to about 28:1.

In U.S. Pat. No. 5,057,743 to Krasko et. al., see specification beginning column 4, lines 27, the fill is described as including lithium iodide in addition to sodium iodide, the text of which is incorporated by reference into the present specification. The amounts of alkali metal iodides (lithium iodide plus sodium iodide) to scandium iodide is preferably in a molar ratio of about 27:1 to about 40:1.5. A preferred ratio of sodium iodide to lithium iodide is a molar ratio of from about 1:1 to about 5:1.

When the chemical fill includes sodium iodide and cesium iodide, they are preferably preset in a molar ratio of from about 20:1 to about 40:1 based on the moles of scandium iodide. More preferably a ratio of 38:1. Cesium is incorporated into the lamp in the preferred amounts as set forth in U.S. Pat. No. 4,709,184 to Keeffe and Krasko, which disclosure as set forth in column 4, lines 19 to 35 is incorporated by reference into the present specification. As set forth, a preferred molar ratio of sodium, scandium and cesium is about 24:1:0.6.

In accordance with the principles of the present invention, the tendency of the lamp to discolor is reduced by the inclusion of elemental platinum metal in the arc tube. Desirable, platinum is present in the amount of 0.1 milligram in the form of a foil or strip which may be loosely added to the fill. Based on the interior volume of the discharge tube or arc tube 1, the amount of platinum preferably present in the arc tube 1 is from about 0.05 to about 0.5, and most preferably about 0.1 micrograms per cubic centimeter of arc tube volumn.

In addition to the above-mentioned components, scandium metal, thorium metal, and mixtures thereof may be added to the fill. A weight dose of scandium elemental metal in the fill has been found desirable to adjust the metal/iodine ratio in the lamp and to getter oxygen impurities.

The present invention may advantageously be used for low wattage type metal halide discharge lamps, i.e., those lamps with a wattage less than 175 watts. For a low wattage metal halide discharge lamp in having a lamp wattage less than 175 watts, e.g., 40 to 150 watts, the platinum metal weight dosage is preferably from about 0.05 to 0.5 micrograms per cubic centimeter of arc tube volume. When the a chemical fill mixture is NaI, CsI and $ScI_3$ and the arc tube has a volume of 0.3–2.2 $cm^3$, a preferred chemical fill consists essentially of about 10 to 13 $mg/cm^3$ mercury and about 90 to about 110 torr starting gas; about 0.5 to about 4.5 $mg/cm^3$ scandium iodide; about 5 to about 25 $mg/cm^3$ sodium iodide; and about 0.5 to about 5 $mg/cm^3$ cesium iodide. Preferably the tube has a wall loading in the range of about 14 to 17 $watts/cm^2$.

The following examples are provided to enable those skilled in this art to more clearly understand and practice the present invention. These examples should not be construed as a limitation upon the scope of the present invention but merely as being illustrative and representative thereof.

EXPERIMENT

Two sets of 100-watt metal halide lamps were made to compare lamps of the present invention with lamps' not including platinum as an aid to reduce discoloration of the lamp. Each of the lamps included a quartz arc tube having an internal volume of about 1.25 $cm^3$, an arc gap of about 14 mm., an electrode insertion length of about 4.3 mm, an overall length of 50 mm, and an overall width of 17 mm. The fill of the arc tube of each lamp includes 13.5 milligrams of mercury and 12 milligram of a tricomponet chemical fill. On a weight percent bases, the tricombination fill includes 86% NaI, 4% CsI, and 10% $ScI_3$. In addition to the above ingredients, one set additionally includes 0.1 milligrams of platinum and 0.13 milligrams of scandium. The second set of lamps contained the same fill as the first set except for the platinum component. In the second set, no platinum was included. The lamps were operated vertically for 10,000 hours with their bases up on a standard 100 W lag ballast.

The performance of the lamps with a platinum tab was superior in comparison with the control group without the platinum tab. For the lamps with platinum, the intial lumens was 90 while for the lamps without platinum the intial lumens was 76. Thus, initial lumens with the platinum were 18% higher than the control group. The lumen maintenance for each group of lamps is calculated as a percent of the intial lumens for the respective group. The lumen maintenance for the lamps with platinum was 80% at 4,000 hours and was 71% at 10,000 hours versus the lamps without platinum which had a lumen maintenace of 67% at 4000 hours and 60% at 10,000 hours. Color temperature was more stable within +100° K. over life as opposed to a 400° K. decrease for the group without platinum. The general color rendering index is also higher and more stable over life for the group with the addition of platinum.

The appearance of the lamps with platinum is different from the non-platinum containing lamps, the platinum containing lamps so not have black tungsten deposit. It was observed that the electrode melt back is less noticeable in lamps with platinum than in lamps without platinum.

While there has been shown and described what at present is considered the preferred embodiment of this invention, it will be apparent to those skilled in the art that various changes and modifications may be made therein without departing from the invention as defined by the appended claims.

What is claimed is:

1. A scandium halide and alkali metal halide discharge lamp type having an enhanced color rendering index and emission spectrum during operation comprising:

an outer sealed glass envelope and a pair of electrical conductors extending into the interior of said glass envelope;

an arc tube disposed within the outer glass envelope, said arc tube including a pair of spaced electrodes being electrically connected to said electrical conductors for creating an electric arc during operation of said lamp;

a chemical fill disposed within the arc tube, the chemical fill comprising an inert starting gas, mercury, alkali metal iodides, and scandium iodide;

said arc tube additionally including a sufficient amount of platinum for improving lamp lumen maintenance during operation.

2. A scandium halide and alkali metal halide discharge lamp in accordance with claim 1 wherein metal alkali metal is selected from the group consisting of the alkali metals of sodium, lithium, and cesium.

3. A scandium halide and alkali metal halide discharge lamp in accordance with claim 2 wherein said chemical fill includes sodium iodide and scandium iodide in a molar ratio of from about 20:1 to about 28:1.

4. A scandium halide and alkali metal halide discharge lamp in accordance with claim 3 wherein said chemical fill includes sodium iodide and cesium iodide in a molar ratio of from about 20:1 to about 40:1.

5. A scandium halide and alkali metal halide discharge lamp in accordance with claim 3 wherein said chemical fill includes sodium iodide and lithium iodide in a molar ratio of from about 1:1 to about 5:1.

6. A scandium halide and alkali metal halide discharge lamp in accordance with claim 3 wherein said chemical fill includes said alkali metal iodides and scandium iodide in a molar ratio of about 27:1 to about 40:1.

7. A scandium halide and alkali metal halide discharge lamp in accordance with claim 3 wherein said chemical fill includes a metal or metal alloy selected from the group consisting of scandium metal, thorium metal, and mixtures thereof.

8. A scandium halide and alkali metal halide discharge lamp in accordance with claim 3 wherein said lamp comprises an arc tube disposed within the outer glass envelope, the arc tube including a support structure disposed within the outer glass envelope to support the arc tube therein, the support structure being electrically isolated from the electrical circuit of the lamp.

9. A low wattage metal halide discharge lamp in accordance with claim 3 wherein said lamp has a wattage of 40 to 150 watts.

* * * * *